US006946040B2

(12) United States Patent
Homma

(10) Patent No.: US 6,946,040 B2
(45) **Date of Patent: *Sep. 20, 2005**

(54) SHAPE MEMORY ALLOY AND METHOD OF TREATING THE SAME

(75) Inventor: Dai Homma, Yokohama (JP)

(73) Assignee: Toki Corporation Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/244,524

(22) Filed: Sep. 17, 2002

(65) Prior Publication Data

US 2003/0010413 A1 Jan. 16, 2003

Related U.S. Application Data

(62) Division of application No. 09/871,619, filed on Jun. 4, 2001, now Pat. No. 6,596,102.

(30) Foreign Application Priority Data

Jul. 6, 2000 (JP) ..... 2000-204927

(51) Int. Cl.[7] ..... C22F 1/10; C22K 1/00
(52) U.S. Cl. ..... 148/563; 148/402
(58) Field of Search ..... 148/402, 563

(56) References Cited

U.S. PATENT DOCUMENTS 4,144,057 A * 3/1979 Melton et al. ..... 148/402
4,337,090 A * 6/1982 Harrison ..... 148/402
4,565,589 A * 1/1986 Harrison ..... 148/402
4,919,177 A 4/1990 Homma
4,950,173 A * 8/1990 Minemura et al. ..... 439/82
5,061,914 A * 10/1991 Busch et al. ..... 337/140
6,596,102 B2 * 7/2003 Homma ..... 148/561
2002/0043456 A1 * 4/2002 Ho et al. ..... 204/192.1
2003/0018381 A1 * 1/2003 Whitcher et al. ..... 623/1.15

FOREIGN PATENT DOCUMENTS

EP 0 460 695 A1 12/1991
JP 59-38367 A 3/1984
JP 3-229844 A 10/1991
JP 7-76747 A 3/1995

OTHER PUBLICATIONS

Ishikawa et al, (Shape Memory Treatment) (P. 30) 1987 (English Translation).
Yuuichi Suzuki, "Practical Shape Memory Alloy" published by Kougoyuchousakai pp. 76–79, with English translation.
"Shape Memory Alloy", by Kazuhiro Ohtuka et al., published by Sangyoutosho pp. 157–161, with English translation.

* cited by examiner

*Primary Examiner*—George Wyszomierski
(74) *Attorney, Agent, or Firm*—Birch, Stewart, Kolasch & Birch, LLP

(57) ABSTRACT

A method of treating a shape memory alloy to improve its various characteristics and to cause it to exhibit a two-way shape memory effect. A raw shape memory alloy having a substantially uniformly fine-grained crystal structure is prepared and then its crystal orientations are arranged substantially in a direction suitable for an expected operational direction, such as tensile or twisting direction or the like, in which the shape memory alloy is expected to move when used in an actuator after the completion of the treatment.

23 Claims, 7 Drawing Sheets

EXAMPLE OF TRANSFORMATION POINTS OF Ti-Ni-Cu BASED SMA APPEARING UPON HEATING (DSC)

PHYSICAL PRORERTIES SUCH AS SPECIFIC HEAT AND ELECTRICAL RESISTANCE REPRESENTING TRANSFORMATIONS

EXAMPLE OF TRANSFORMATION POINTS OF Ti-Ni-Cu BASED SMA APPEARING UPON HEATING (DSC)

EXAMPLE OF CRYOGENIC TRANSFORMATION POINT OF Ti-Ni-Cu BASED SMA (°C)

TEMPERATURE – STRAIN CURVE

SHAPE MEMORY ALLOY AND METHOD OF TREATING THE SAME

This application is a divisional of application Ser. No. 09/871,619, filed on Jun. 4, 2001, now U.S. Pat. No. 6,596,102, the entire contents of which are hereby incorporated by reference and for which priority is claimed under 35 U.S.C. § 120; and this application claims priority of application Ser. No. 2000-204927 filed in Japan on Jul. 6, 2000 under 35 U.S.C. § 119.

BACKGROUND OF THE INVENTION

1. Field of the Invention

This invention relates to a shape memory alloy (SMA) suitable for actuators and a method of treating the same.

2. Related Art

Heretofore, upon treating a raw shape memory alloy so as to make it suitable for use in actuators, generally it has not been done to refine crystal grains and control crystal orientations of the raw shape memory alloy.

On the other hand, in order to use a shape memory alloy, it is necessary to impart a required shape to the shape memory alloy, and therefore to perform a heat treatment peculiar to each kind of shape memory alloy. This heat treatment is called shape memory treatment and it is necessary to strictly control various conditions thereof, as it is a very delicate treatment. For example, the following methods have been well known as shape memory treatments for common Ti—Ni based shape memory alloys. The first method, which is referred as medium temperature treatment, is the one wherein a shape memory alloy is sufficiently work hardened and then cold worked into a desired shape, and thereafter, held at a temperature of 400 to 500° C. for a few minutes to several hours with the desired shape being restrained. The second method, which is referred as low temperature treatment, is the one wherein a shape memory alloy is held at a temperature of 800° C. or above for some time, thereafter rapidly cooled and cold worked into a desired shape, and then held at a low temperature of 200 to 300° C. with the desired shape being restrained (Illustrated idea collection of applications of shape memory alloys in the latest patents, written and edited by Shoji Ishikawa, Sadao Kinashi and Manabu Miwa, published by Kogyo-chousakai, pp. 30).

In general, conventional shape memory alloys suffer from the following shortcomings when used in actuators.

(a) The response characteristic (speed) is inferior.

(b) Usable temperature range is restricted, since $M_s$ and $M_f$ points ($M_s$ being the temperature at which the martensite phase transformation starts and $M_f$ being the temperature at which the martensite phase transformation ends) are difficult to be raised.

(c) Only a small force can be effectively extracted from the shape memory alloy.

(d) The service life before being broken is short.

(e) The shape memory alloy tends to lose the memory of an imparted configuration and permanent strain tends to be produced in the shape memory alloy for a short period of time.

(f) The strain which can be extracted from the shape memory alloy as a movement (hereinafter referred as operational strain) is decreased for a short period of time.

(g) Shape memory alloy materials, such as Ti—Ni based or Ti—Ni—Cu based alloys and the like, which are intermetallic compounds having strong covalent bonding characteristic and are difficult to work, are difficult to use when they are in certain compositions, since they are very brittle and fragile.

With such shortcomings, 80 to 90% or more of applications of shape memory alloys have been those wherein they are used as superelastic spring materials and only the rest has been directed to actuators. Moreover, most of the shape memory alloys for use in actuators have been formed into the shape of a coil spring, wire or plate and have been expected to be reverted from a configuration deformed by bending or twisting and bending to the original configuration upon application of heat (in case the shape memory alloy is formed into a coil spring shape, though macroscopically or apparently it is deformed as if it were elongated or compressed upon application of a force thereto, in a true sense the deformation it is subject to is a twisting and bending one). The reason for utilizing reversion from a bending deformation or twisting and bending deformation as stated above has been that the shape memory alloy should be used so that its small strains may be multiplied since the range of its shape memory effect (SME) stably available is very narrow. Though it is said that, in conventional shape memory alloys, the maximum operational strain reaches a few percent to about 10 percent, this is true only when deformation and shape recovery are performed only once or a few times. Practically speaking, when deformation and shape recovery are repeated over large cycle numbers with regard to the conventional shape memory alloy, the operational strain is decreased and the alloy loses the memory of the imparted configuration and eventually is broken.

All of the conventional shape memory treatments intend to keep the shape stability while obtaining the pseudoelasticity and shape memory effect by partly producing microstructures which can cause pseudoelasticity and shape memory effect in microstructures of the shape memory alloy strengthened by work hardening. In other words all of the conventional shape memory treatments are those which obliges to sacrifice pseudoelasticity and shape memory effect to some extent to keep shape stability.

On the other hand, the present inventor has disclosed in U.S. Pat. No. 4,919,177 a method of treating Ti—Ni based shape memory alloy wherein a Ti—Ni based polycrystalline shape memory alloy material is subjected to a heat cycle which rises and drops over the transformation region of the shape memory alloy as well as to a directional energy field. According to this method, the crystal orientations of the shape memory alloy are rearranged along a specific direction and the disadvantages of the conventional shape memory alloy are overcome considerably.

However, in the method disclosed by the present inventor, the crystal grains of the shape memory alloy are not refined but caused to grow in size. Besides, since a tensile force is applied to the shape memory alloy in the final step of arranging the crystal orientations, there is a tendency that the microstructure of the shape memory alloy finally obtained is destroyed by the tensile force. Therefore, it is still not enough in overcoming the disadvantages of the conventional shape memory alloy.

SUMMARY OF THE INVENTION

It is accordingly an object of the present invention to provide a shape memory alloy having a good response characteristic and a method of treating a shape memory alloy for obtaining such a shape memory alloy.

It is another object of the present invention to provide a shape memory alloy which can be used over a wide range of temperature and a method of treating a shape memory alloy for obtaining such a shape memory alloy.

It is still another object of the present invention to provide a shape memory alloy from which a greater force can be practically and effectively extracted and a method of treating a shape memory alloy for obtaining such a shape memory alloy.

It is a further object of the present invention to provide a shape memory alloy from which great operational strains can be extracted over large cycle numbers and a method of treating a shape memory alloy for obtaining such a shape memory alloy.

It is a still further object of the present invention to provide a shape memory alloy exhibiting a huge two-way shape memory effect (reversible shape memory effect) and a method of treating a shape memory alloy for obtaining such a shape memory alloy.

It is another object of the present invention to provide a shape memory alloy having a long service life and a method of treating a shape memory alloy for obtaining such a shape memory alloy.

It is still another object of the present invention to provide a shape memory alloy which does not lose its memorized shape easily and a method of treating a shape memory alloy for obtaining such a shape memory alloy.

It is a further object of the present invention to provide a shape memory alloy of which operational strain diminishes less even with an increase of a deformation-recovery cycle number and a method of treating a shape memory alloy for obtaining such a shape memory alloy.

It is a still further object of the present invention to provide a shape memory alloy which exhibits stably the aforesaid various excellent properties over large cycle numbers for a long period of time and a method of treating a shape memory alloy for obtaining such a shape memory alloy.

It is another object of the present invention to provide a method of treating a shape memory alloy which makes it possible to employ, as raw materials, those shape memory materials which have been regarded as difficult to use because of their brittleness and easiness to crack and convert them into ductile shape memory alloys in the shape of a wire or sheet etc.

It is yet another object of the present invention to provide a method of treating a shape memory alloy which makes it possible to arrange crystal orientations of a shape memory alloy without damaging the microstructure of the alloy.

Crystal grains of a shape memory alloy have orientations and there exist a plurality of orientations along which reversible slips or shearing deformations (variants), wherein microscopically relative moving ranges between the atoms of the alloy are restricted, can appear, though they are limited in number. For example, in case of a Ti—Ni based shape memory alloy, there are as much as twenty four (24) orientations along which the deformations referred to as variants can occur. In the present invention, the crystal orientations of the shape memory alloy are arranged substantially along a direction suitable for an expected operational direction, in other words, a direction suitable for a movement of the shape memory alloy in the expected operational direction. The term "expected operational direction" as herein used means a direction such as a tensile or twisting direction or the like in which the shape memory alloy is expected to move when used in an actuator after the completion of the treatment. For example, when a shape memory alloy in the wire shape is used in a contraction-relaxation fashion, the expected operational direction is a tensile direction, while when a shape memory alloy in the coil spring shape is used, the expected operational direction is a torsion direction. (In case a shape memory alloy in the coil spring shape is used, it performs shape recovery from a twisting and bending deformation upon heating. Therefore, strictly speaking, it may be said that the expected operational direction in this case is a torsion and bending direction. However, the substantial expected operational direction is a torsion direction, because bending deformation comprises a negligible percentage.)

A method of treating a shape memory alloy in accordance with the present invention comprising the steps of providing a raw shape memory alloy with a substantially uniformly fine-grained crystal structure; and arranging crystal orientations of the raw shape memory alloy substantially along a direction suitable for an expected operational direction.

It is preferred that the average grain size of the raw shape memory alloy is selected to be 10 microns or less in the step of providing the raw shape memory alloy with a substantially uniformly fine-grained crystal structure. Most preferred is the average grain size in the range of 1 micron to several microns or less. With such grain size, the shape memory alloy after the completion of the treatment is particularly stable when subjected to deformation-recovery cycle.

In general, specific characteristic properties of crystalline materials are based on the phenomena in crystal grains of the materials. Accordingly, in many cases, these specific characteristic properties should naturally be most remarkably recognized when the materials are of single crystal. For this reason, when the excellent properties or functions of some material are to be utilized, in general, the best results can be obtained when the material is of single crystal. Basically the shape memory alloy is no exception on this matter. A shape memory alloy of single crystal can be deformed in a slip direction by very small force in the range where reversible slip deformation can occur under a low temperature at which it is in the martensitic phase as a whole (Slip deformation in this specification means shearing deformation which is the cause of the shape memory effect and wherein reversible movement is possible within a limited range, but it does not mean permanent and continuous slip between atoms which is the cause of the plastic deformation).

However, in practice it is extremely difficult to industrially produce the single crystalline material, and the production of it, even when achieved, should be very expensive. Besides, in case of a shape memory alloy, when it is of single crystal, its microstructure becomes unstable.

Of course conventional shape memory alloys are polycrystalline substances, and in general, orientations of the respective crystals thereof have been random and the grain sizes of respective crystals are uneven, and thereby it is thought that aforesaid various shortcomings are caused (this will be discussed later in detail).

The present inventor has found that a shape memory alloy can be obtained which has both advantages of the single crystalline shape memory alloy and those of the conventional polycrystal shape memory alloys, when the shape memory alloy, as in the present invention, is formed of a polycrystal material and provided with a substantially uniformly fine-grained crystal structure, and the crystal orientations thereof are arranged along a direction suitable for an expected operational direction. When the crystal grain sizes of the alloy are made substantially uniform and the crystal orientations are arranged along a direction suited for a desired movement of the alloy, even if gigantic shape recovery force is produced in respective crystal grains, no part of the alloy is subject to an excessive deformation and the internal structure of the alloy is difficult to destroy. Besides, when respective crystal grains are adequately small, structural contradictions caused by differences between deformation directions of the respective crystal grains, etc. are also small and thereby the respective crystal grains themselves are difficult to destroy. Moreover, in such a material, since the volume proportion of the structure at and around the crystal grain boundaries to that within the grains is comparatively larger, its ability to absorb the structural contradictions is high. Further, such a material can be reformed into a shape memory alloy in the shape of a wire or sheet etc. which is sufficiently ductile over a wide strain range, even in the case where it is brittle when it is a raw material. The reason for this is presumed that, in such a material, the structure at and around the crystal grain boundaries exhibits properties like those of an amorphous material. Even the respective crystal grains are fine, if the crystal orientations are arranged, comparatively large shape memory effect can be extracted from the shape memory alloy. A force required to deform the shape alloy is small, since the orientations of the respective crystals along which the crystals are easy to move are arranged in the same direction. Because the volume proportion of the structure at and around the crystal grain boundaries to that within the grains is comparatively larger, large elastic energy can be stored at and around the crystal grain boundaries without employing the measures of depositing impurities there, or the like, and thereby a stable and large two-way shape memory effect can be obtained as well as the property that a force required to deform the alloy is small.

Thus, the shape memory alloy in accordance with the present invention has the following excellent properties, though some of them have been already mentioned above.

(A) Since the temperature hysteresis is small on the temperature-stress diagram and the transformation temperature range is narrow, heating and cooling of the alloy can be taken place quickly, the response of the alloy is good, and a high-speed reciprocating motion can be achieved. For example, when applied to a Ti—Ni—Cu based shape memory alloy, the temperature hysteresis can be almost zero over a comparatively wide range. A successive reciprocating operational strain reaching to almost 80% of that in the full stroke (strain $\epsilon$=4%) could be successfully extracted from a shape memory alloy in accordance with the present invention with a 150 Mpa load and a temperature difference of merely 10° C. This, when compared to a engine, is equivalent to the revolution speed is remarkably raised with the same size. Accordingly, it is equivalent to that the horsepower as well as the load capacity is considerably raised. A significant improvement of the responsiveness can be expected, when used in a mechanism such as a servo actuator wherein two-way movement is required.

(B) The force which can be practically extracted from the shape memory alloy (hereinafter referred as recovery force) can be increased. The recovery force does not depend on the maximum recovery stress but the limit of the stress repeatedly usable in consideration of fatigue of the alloy, etc. When compared to a engine or motor, the recovery force corresponds to the maximum torque. With the shape memory alloy treated by the method in accordance with the present invention, the limit of the stress practically available in the reiterative operation is high, even when the maximum recovery stress is same as that of the conventional shape memory alloy. The conventional shape memory alloy has a small recovery force, and if operated repeatedly with an excessively large stress applied thereto, it suffers from loss of the memory of the imparted configuration, decrease of the operational strain and rupture, as stated above. It means shortening of service life of the actuator. This is the reason why most of conventional shape memory alloy actuators have been formed in the shape of a coil spring, as previously stated. With the coil spring shape, the strain produced in the alloy is very small when the alloy is deformed. Therefore, the stress actually used has been considerably small as compared with the maximum stress practically available.

(C) Large operational strains can be extracted over large cycle numbers. The shape memory alloy in accordance with the present invention, when formed into a rectilinear shape, can achieve a deformation-shape recovery cycle with a tensile strain of 5% or more. The value of the operational strain, 5% or more stands comparison with that a 1 m long round bar is expanded and contracted by 5 cm or more. This magnitude of strain is much larger than that of the strain which an ordinary coil spring is subject to when it is deformed and restored between the coil and rectilinear shape. This value is much larger than the ranges of strains available in case of conventional shape memory alloys including superelastic alloys. When the treatment in accordance with the present invention is applied to a brittle raw shape memory alloy material such as Ti—Ni—Cu based shape memory alloy and the like, huge operational strains as stated above can be extracted stably over more than one hundred million cycles. When the conventional shape memory alloy is used in the coil spring shape, in most cases, the moving strain is less than 0.1% in tensile strain equivalent. In other words, in most cases, the coil spring of a shape memory alloy has been used with almost the same magnitude of displacement as the coil spring of a non-shape memory alloy metal such as iron and the like.

(D) It is possible to cause a shape memory alloy to exhibit a huge two-way shape memory alloy effect. The two-way shape memory effect is a phenomenon wherein a shape memory alloy recovers the original configuration upon heating and deforms into another configuration upon cooling, and no force or only a very small force is required when the alloy is subject to the deformation at a low temperature in a direction opposite to the shape recovery. Apparently, it appears that the shape memory alloy remembers two configurations, the deformed configuration at a low temperature and the original configuration at a high temperature. For instance, in case the shape memory alloy is rectilinear and the deformed configuration (length) thereof is the one stretched from the original configuration (length), the shape memory alloy contracts to the original length and becomes hard upon heating, while it extends by itself to the deformed length and becomes soft just like a muscle relaxes upon cooling, even in the absence of a load. In other words, the shape memory alloy expands and contracts, driven by heating and cooling alone in the absence of a bias force from the outside. According to literature, etc., it has been thought that, generally the two-way shape memory effect is a phenomenon observed only within the range wherein a strain $\epsilon$ is 1% or less in tensile strain equivalent and it is difficult to put it to practical use since it is unstable. In fact, hitherto devices utilizing the two-way shape memory effect have been hardly found.

According to the present invention, however, it is possible to cause a huge two-way shape memory effect almost over the whole range wherein the shape memory effect occurs, namely, the whole range of recoverable strain. According to the present invention, the two-way shape memory effect with a strain of 5% can be exhibited even in the absence of a load. The present inventor postulates that, since the polycrystal shape memory alloy in accordance with the present invention has crystals each of which orientation, size and position are adapted to deformations from the outside, a stable two-way shape memory effect can be induced almost in the whole range of the operational strain, if there exists in the alloy the slightest level of a residual stress field resulted from the working in a direction opposite to the shape recovery direction. This huge two-way shape memory effect appears stably over about one hundred million cycles in the absence of a load.

(E) The shape memory alloy in accordance with the present invention has a long service life. The conventional shape memory alloy has a service life of about one hundred thousand cycles, at the largest, even with the small operational strain. Particularly, in case a movement wherein the operational strain exceeds 2% in tensile strain equivalent is performed, there is a tendency that its service life becomes extremely short. However, the shape memory alloy in accordance with the present invention provides a stable movement over one hundred million cycles with a huge operational strain reaching nearly 5%.

(F) The memory of the imparted configuration and the range of the operational strain are stable, that is, the memory of the imparted configuration and the range of the operational strain do not diminish with cycle number of the deformation and recovery or do only slightly. In other words, the magnitude of the operational strain has little effect on the service life of the shape memory alloy. The reason for it is postulated that the shape memory alloy in accordance with the present invention has the orientations, sizes and arrangements of the respective crystals in a state adapted to deformations from the outside. It is presumed that the deformation from the outside is undertaken, to a certain extent, mainly by the crystals which achieve a huge reversible thermo-elastic deformation that is characteristic of a shape memory alloy, while the deformation larger than it is undertaken by the structure at and around the crystal grain boundaries wherein a reversible thermo-elastic deformation is hardly produced. With such structure of the shape memory alloy, displacements, plastic deformations and rotations of the respective crystal grains are hard to occur even with large cycle numbers, and the alloy is hardly subject to a permanent deformation.

(G) Even when the raw material is brittle, it can be reformed into a ductile shape memory alloy in the shape of a wire, sheet or the like. The shape memory alloy in accordance with the present invention has higher apparent ductility than shape memory alloys treated by the conventional shape memory treatment since it consists of the fine crystal grains reversibly deformable and the structure at and around the crystal grain boundaries which exhibits amorphous like properties and occupies a considerable part of the alloy with regard to volume.

(H) The various excellent properties of the shape memory alloy mentioned above are stable over a long time of period and large cycle numbers.

In a particular aspect of the method of treating a shape memory alloy in accordance with the present invention, the step of providing a raw shape memory alloy having a substantially uniformly fine-grained crystal structure comprises the steps of heating the raw shape memory alloy in an amorphous state or a state similar thereto to the temperature at which recrystallization begins or a little above for a short period of time, with a stress applied to the raw shape memory alloy in the expected operational direction at least in the stage where a recovery recrystallization begins, to produce a substantially uniform fine-grained crystal structure with an anisotropy in the expected operational direction, while relaxing the internal stress generated in the raw shape memory alloy in the expected operational direction.

In case the raw shape memory alloy is not in an amorphous state or a state similar thereto, the raw shape memory alloy can be be put into a state similar to amorphous state, for instance, by being subject to a severe cold working. It is preferable that the severe cold working is achieved at a cryogenic temperature which is sufficiently lower than the temperature singular point B of the raw shape memory alloy. The point B is an inflection point observed in the sub-zero temperature range and is associated with transitions of the physical property values such as specific heat, electrical resistance and the like (This will be explained later in more detail). The object for this is to completely transform non-martensite structures remaining in the alloy, even if the amount of them are very small, into the martensite. In general, the so called martensite finished point $M_f$ at which the shape memory alloy transforms completely from austenite to martensite is the temperature which is measured with respect to a specimen completely annealed. In worked materials, however, there remain a considerable amount of the non-martensite structures even at this temperature. The non-martensite structures may be retained austenite, a structure resulted from work hardening or the like.

Upon heating the raw shape memory alloy to the temperature at which recrystallization begins or a little above for a short period of time, the raw shape memory alloy may be either in a state where a stress is applied to it in the expected operational direction or where it is constrained in a shape not loosened in the absence of a load. At this stage, since the raw shape memory alloy has a martensitic component which can recover the shape in the expected operational direction upon heating, if it is constrained in a shape not loosened in the absence of a load, a stress is produced in the expected operational direction while heating and thereby the same result is obtained as when the alloy is constrained with a stress applied thereto prior to heating as stated above. What is essential is that at least when a recovery recrystallization begins the raw shape memory alloy is in a state where a stress is loaded thereto in the expected operational direction.

In the particular aspect of the method of treating a shape memory alloy in accordance with the present invention, the step of arranging crystal orientations of the raw shape memory alloy comprises the steps of subjecting the raw shape memory alloy to a high level of deformation by means of a stress in the expected operational direction at a very low temperature at which the austenite phase does not remain in the raw shape memory alloy so that a slide deformation is introduced into the crystal grains of the raw shape memory alloy which have been transformed completely into the martensite phase, within a reversible range along the direction of the stress; heating the raw shape memory alloy to a temperature between $A_f$ (a temperature at which the austenitic transformation ends) and the recrystallization temperature with a stress applied to said raw shape memory alloy in the expected operational direction so that the directions of reversible slip motions of the respective crystal grains of said raw shape memory alloy are arranged in the expected operational direction.

The crystal orientations of the raw shape memory alloy are arranged when the directions of reversible slip motions of the respective crystal grains are arranged in the expected operational direction. Hereupon, the orientation of crystal grain means the one where a reversible slip deformation due to the martensitic transformation is easy to occur practically such as one of orientations of variants and the like, but not necessarily one and the same orientation from the view point of the crystallography.

The step of introducing a slide deformation to the crystal grains and that of arranging the directions of reversible slip motions of the s crystal grains may be repeated a required number of times. Generally it suffices to repeat one to three times.

In the method of treating a shape memory alloy in accordance with the present invention, it is preferable to take place a step of running-in, after having rearranged the crystal grains of the raw shape memory alloy along the direction which is suited for the reversible deformation of the alloy in the expected operational direction as stated above, in order to obviate instability of the alloy which appears in the initial stage of its repetition movement. This running-in step is a process which aims for the same effect as the training process which has been employed in the conventional shape memory treatment.

Preferably, the running-in step is performed, after arranging the directions of reversible slip motions of the respective crystal grains of the raw shape memory alloy in the expected operational direction, by subjecting the raw shape memory alloy to a heat cycle between a temperature of $M_f$ point or below and a temperature at which only a high level of plastic deformation is relaxed, while controlling a stress applied to the raw shape memory alloy without restraining the strain introduced in the raw shape memory alloy. In general, it is preferable that a few to several tens cycles of the heat cycle is applied to the raw shape memory alloy. In accordance with the running-step, a work hardening and a structural defect having an elastic energy field which contribute to the dimensional stability and two-way shape memory effect of the alloy can be stored in the microstructure at and around the crystal grain boundaries to the desired degree and thereby the instability of the alloy which appears in the initial stage of its repetition movement can be dissolved.

It has not been yet fully elucidated theoretically what phenomenon occurs in the shape memory alloy and why the alloy exhibits various excellent properties as stated above when the treatment in accordance with the present invention is carried out. However, to make the present invention easily understood, a supplementary explanation will be given hereunder on the basis of a hypothesis the present inventor holds at present.

It is considered that in a polycrystalline shape memory alloy each crystal performs as a single crystal, while the structure at and around the crystal grain boundaries connects the crystals with each other. Therefore, in case orientations and sizes of the crystals are random, when the respective crystals present large deformations due to the superelasticity and shape memory effect, the structure at and around the crystal grain boundaries is subject to structural contradictions caused by the deformations of the crystals. The conventional shape memory alloy, treated with an ordinary shape memory treatment after manufactured by ordinary working such as casting, hot working and the like, is polycrystalline and random in the crystal orientations and sizes thereof, and some of the crystals thereof have been destroyed by strong working. Such circumstances constitute obstacles disturbing a smooth deformation and shape recovery of the alloy, and thereby a considerable force is required to deform the alloy, even when at a temperature sufficiently low for the martensitic transformation to be completed. Therefore, satisfactory shape memory effect can not be achieved when it is used as an actuator, even after the shape memory treatment.

The shape recovery force within the crystal grain is strong and has enough magnitude to deform plastically and destroy the structure at and around the crystal grain boundaries which constitutes a connection between crystal grains and the crystal grains which is not yet in the shape recovery state. This may explains the reason why the conventional shape memory alloy soon loses the memory of the imparted shape and becomes hard, with the operational strain thereof decreasing, when it is subject to repetitions of a large deformation and shape recovery. It may be because the interior of the shape memory alloy is changed little by little due to the great shape recovery force. Especially, in the case where the shape memory alloy performs the shape recovery when it is subject to a large deformation and restrained in the deformed configuration, the shape recovery forces of the respective crystal grains act on the interior of the alloy material at a stretch and the shape memory alloy deteriorates rapidly. The fact is that, in case of the conventional shape memory alloy, the superelastic spring and the like, the above-mentioned defect should be covered up by practicing strong working to cause work hardening in the alloy, and consequently constructing the internal structure in the alloy where the huge shape recovery forces of the crystals are restrained.

On the other hand, in accordance with the present invention, the sizes of the crystal grains being made even and the orientations thereof being arranged along the predetermined direction, even if a huge shape recovery force is produced in each crystal grain, there is no part in the alloy where an excessive deformation is produced and the internal structure of the alloy becomes hard to break. Besides, if the respective crystal grains are adequately fine, structural contradictions produced due to the differences between the orientations of the respective crystal grains or the like are small, and the crystal themselves becomes hard to break. Moreover, in such a fine-grained material, since the volume proportion of the structure at and around the crystal grain boundaries to that within the grains is comparatively larger, the ability to absorb the structural contradictions is high. Further, probably as the structure at and around the crystal grain boundaries exhibits properties like those of an amorphous material, it can be converted into a shape memory alloy in the shape of a wire or sheet, etc. which is sufficiently ductile over a wide strain range, even in the case where it is brittle as a raw material. Though the respective crystal grains are fine, since the crystal orientations are arranged along the specific direction, a comparatively large shape memory effect can be extracted from the shape memory alloy. The force required to deform the shape alloy is small, since the orientations of the respective crystals along which they are easy to move are arranged along the specific direction. Because the volume proportion of the structure at and around the crystal grain boundaries to that within the grains is comparatively larger, large elastic energy can be stored at and around the crystal grain boundaries without employing the measures of depositing impurities there, or the like, and thereby a stable and large two-way shape memory effect can be obtained as well as the property that a force required to deform the alloy is small.

When crystal orientations of a shape memory alloy are random, the larger the average grain size of the shape memory alloy is, more conspicuously the shape memory effect occurs. However, in that case, stability as a material is deteriorated. The reason for it is thought that structural contradictions are liable to be produced in the alloy due to the large grain sizes and random crystal orientations, causing changes of structure in the alloy. For instance, a treatment for a shape memory alloy generally called high temperature treatment has been known wherein the shape memory alloy is annealed sufficiently at a high temperature. According to this treatment, because the crystal grain sizes become larger, a large shape memory effect can be induced, but loss of the memorized shape, generation of a permanent deformation and decrease of the operational strain, etc. are caused soon with a deformation-recovery cycle number. Accordingly, though large operational strains can be extracted, the alloy becomes functionally unstable, and thereby nowadays this high temperature treatment is not put to practical use. On the contrary, when the crystal grains are fine, though the magnitude of the shape memory effect decreases relatively, the shape memory alloy becomes materially stable, since structural contradictions produced in the alloy due to the movement of the respective crystals become small and affect less the respective crystals.

Besides, as stated before, with a fine-grained structure, the volume proportion of the structure at and around the crystal grain boundaries to that within the grains is larger, as compared with in the case of a coarse-grained structure. Accordingly, the properties of the boundaries of crystal grains appears outside conspicuously. It is considered that the structure at around the crystal grain boundaries is in disorder and amorphous like properties are dominant there, as compared with the interior of the crystal grain which has a well-ordered atomic arrangement. The metal structure at and around the crystal grain boundaries and that within the grains are structurally different material, though they make little difference in composition. Naturally, the properties of the metal structure at around the crystal grain boundaries must differs very markedly from those of the metal structure within the grains. While it is easy to impart a deformation related to the shape memory effect to the structure within the crystal grains, it is difficult to impart such deformation to the structure at around the crystal grain boundaries, since it is constrained, getting between the crystal grains, and has poor reversible deformability. Therefore, it is considered that the metal structure at and around the crystal grain boundaries and that within the grains are two different materials. As a matter of course, transformation points within crystal grains differ from those at and around the crystal grain boundaries. It is thought that the process of rearranging the crystal orientations along the specific direction in the present invention uses the aforesaid properties of the crystal grain boundaries and therearound.

Most of conventional shape memory alloy production methods and shape memory treatments control strains of the shape memory alloy to define a shape of a finished shape memory alloy and a memorized shape. On the contrary, one of the distinguishing characteristics of the present invention is that most of the main processes thereof are carried out in a state where not the strain but the stress is controlled, allowing the raw shape memory alloy to deform freely. By not controlling the strain, the present invention utilizes the property of the shape memory alloy that the alloy itself reconstructs the internal structure thereof to be adapted for the movement circumstances thereof.

Besides, since the entire treatment process is carried out in rapid dynamic heating and cooling operations, long spells of heat treatment is not required unlike in the case of conventional treatments, though the procedure is comparatively complicated. Therefore, a high speed and consecutive large-scale process for treating a shape memory alloy material can be attained which provides a high-performance shape memory alloy.

Shape memory alloys, more particularly Ti—Ni based and Ti—Ni—Cu based shape memory alloys are not ordinary alloys consisting of two or more metals simply mixed together but intermetallic compounds having strong covalent bonding character. Due to the strong covalent bonding character, they have characteristics like those of inorganic compounds such as ceramic and the like, though being metal. Free electrons are restrained considerably within them because of the strong covalent bonding as compared with the case with metallic bond. Smallness of the free electron movement within them is supported by their properties of poor heat conduction and high electric resistance, though they are metal. The difficulty of free electron movement makes it hard for the fusion and reorganization of the electron cloud to occur. This is a strong reason that Ti—Ni and Ti—Ni—Cu based shape memory alloys are brittle materials which are hard to plastically deform. Though the treatment in accordance with the present invention can be applied to all kinds of shape memory alloys, particularly it is very effective when applied to shape memory alloys, such as Ti—Ni or Ti—Ni—Cu based shape memory alloys or the like, which have strong covalent bonding character and are brittle as raw materials. When the treatment is applied to such materials, the service life, the moving range and the dimensional stability thereof are remarkably improved especially in repetition action under a heavy load, and the ductility thereof is also improved. Moreover, it becomes possible to use alloy compositions which hitherto have been considered to be no use for shape memory alloys, as alloys with them being hard to work or being too brittle even though possible to be worked. Accordingly, it can be expected to create new shape memory alloys which have unprecedented properties.

In another particular aspect of the method of treating a shape memory alloy in accordance with the present invention comprises the steps of subjecting a raw shape memory alloy having an anisotropy in an expected operational direction to a high level of deformation by means of a stress in the expected operational direction at a very low temperature at which the austenite phase does not remain in the raw shape memory alloy so that a slide deformation is introduced into the crystal grains of the raw shape memory alloy which have been transformed completely into the martensite phase, within a reversible range along the direction of the stress; heating the raw shape memory alloy to a temperature between $A_f$ and the recrystallization temperature with a stress applied to said raw shape memory alloy in the expected operational direction so that the directions of reversible slip motions of the respective crystal grains of the raw shape memory alloy are arranged in the expected operational direction.

In this case, the raw shape memory alloy is not necessarily should have substantially uniformly fine-grained crystal structure. According to this aspect, also the crystal orientations are arranged along the direction suitable for the expected operational direction without breaking the structure of the shape memory alloy, as in the aforesaid aspect.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The foregoing and the other objects, features and advantages of the present invention will become apparent from the following detailed description when taken in connection with the accompanying drawings. It is to be understood that the drawings are designated for the purpose of illustration only and are not intended as defining the limits of the invention.

DETAILED DESCRIPTION OF THE INVENTION

Figure 1:
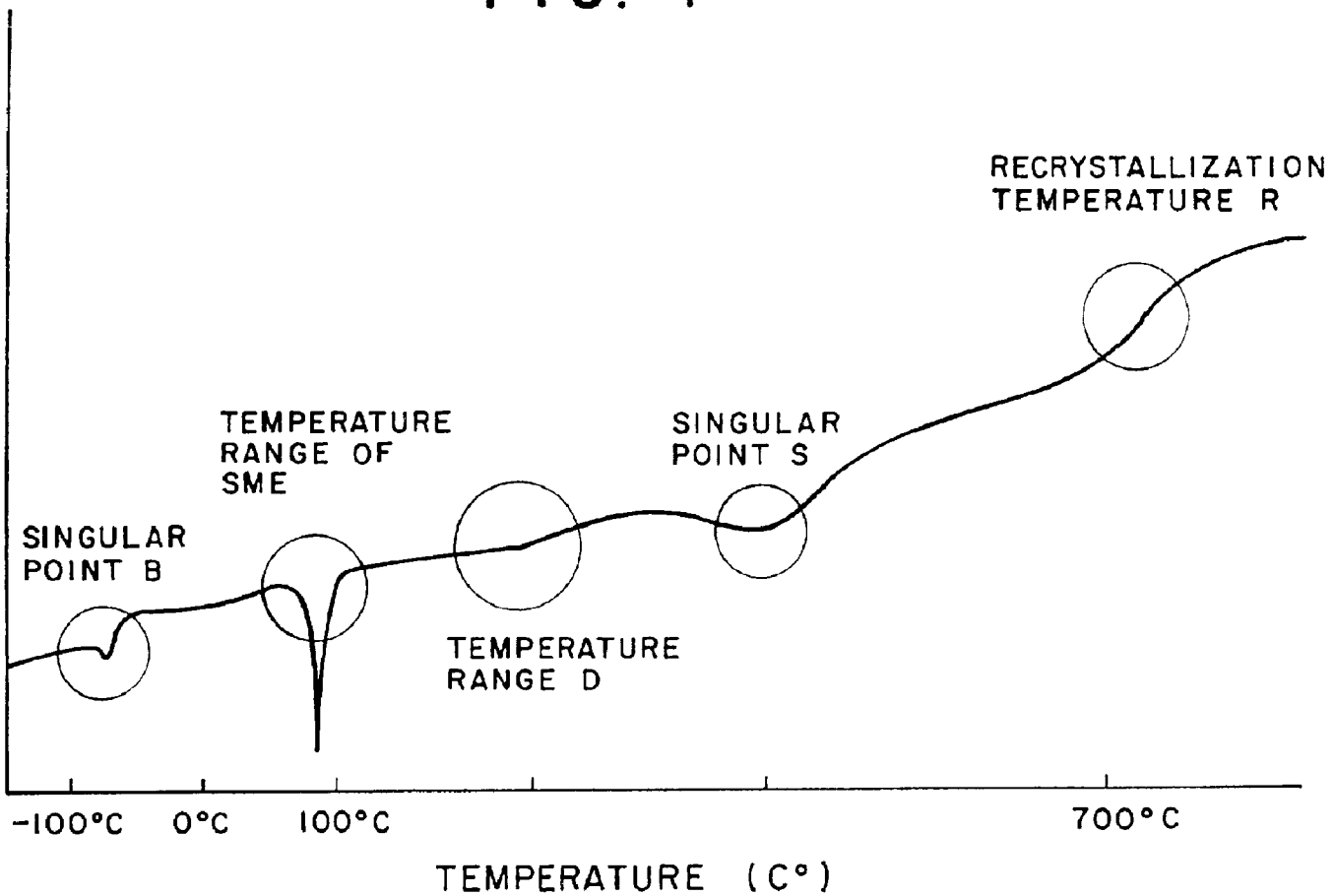
FIG. 1 is a schematic presentation of transformation points and temperature singular points of a raw shape memory alloy in a first embodiment of the treatment in accordance with the present invention.

The present invention will hereunder be described in conjunction with preferred embodiments of the invention which are shown in the drawings. In the drawings like reference numerals are used throughout the various views to designate like parts.

FIGS. 4 through 9 show a first embodiment of the method of treating a shape memory alloy in accordance with the present invention. In this embodiment, it is expected that upon using the finished shape memory alloy, the alloy is contracted to a memorized length, namely original length upon heating, while it relaxes upon cooling, expanding to a original deformed length, that is, a length with an elongation deformation from the memorized length. Therefore, the expected operational direction is a tensile direction in this embodiment. In this embodiment, a Ti—Ni based shape memory alloy material and a Ti—Ni—Cu based shape memory alloy material containing 8 to 12 atomic percent Cu are used as raw shape memory alloys 1.

The treatment in this embodiment basically consists of three stages. The first stage (Steps 1 and 2) is a process of producing fine-grained anisotropic crystals. The second stage (Steps 3 to 5) is a process of rearranging the respective crystals to conform to the expected operational direction of the alloy. The third stage (Step 6) is a running-in process of dissolving instability of the alloy which appears in the beginning of the reiterative operation. However, the essence of the treatment resides in the first and second stages. Upon completion of the second stage, a high performance shape memory alloy for actuators is already obtained. Hereunder the treatment of this embodiment will be explained in order.

(Preparatory operation)

Figure 2:
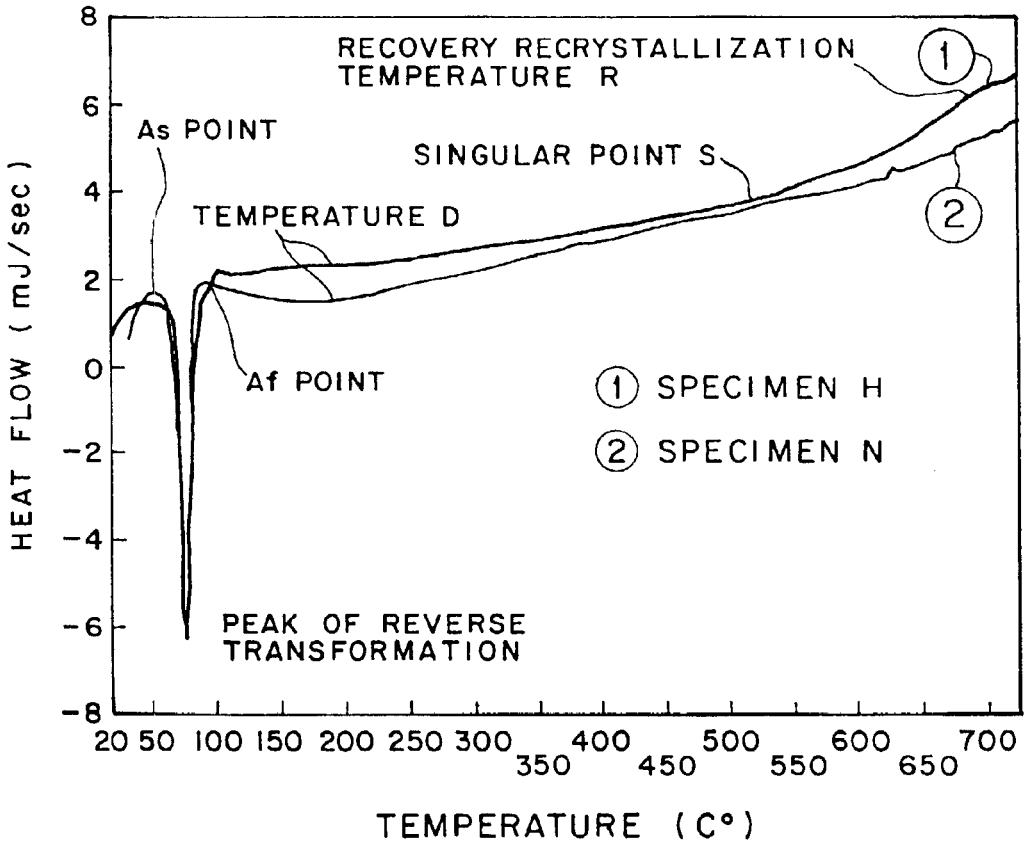
FIG. 2 is a presentation of the transformation points and the temperature singular point S, etc. of a Ti—Ni—Cu based shape memory alloy appearing upon heating which are actually measured with a DSC (Differential scanning calorimeter).
Figure 3:
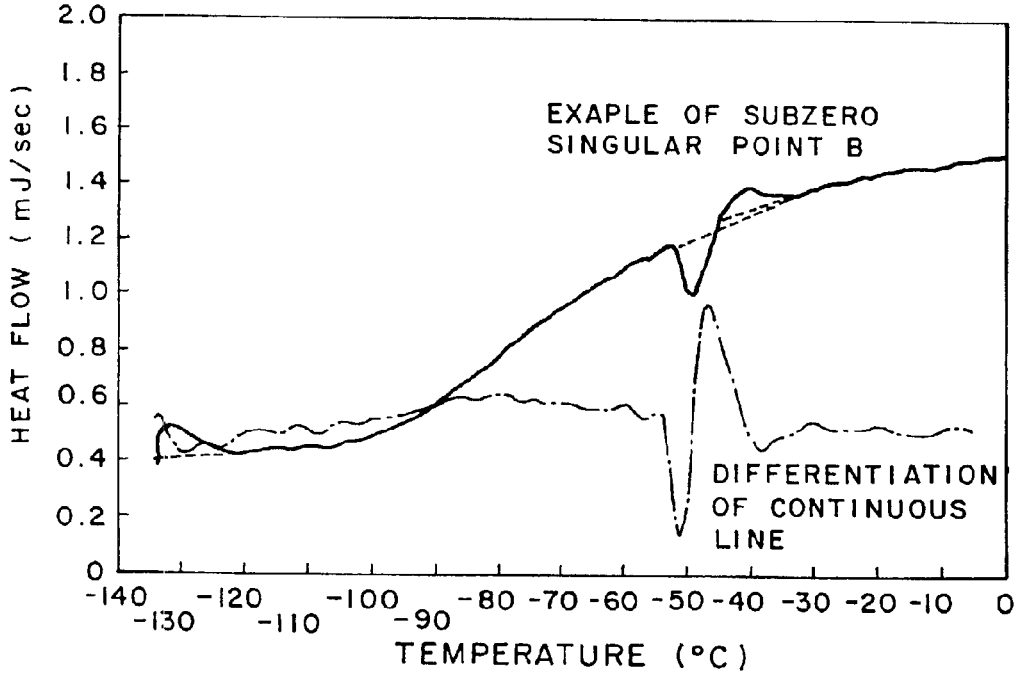
FIG. 3 is a presentation of the cryogenic temperature singular point B of a Ti—Ni—Cu based shape memory alloy actually measured with a DSC.

Raw shape memory alloy materials manufactured by casting and hot working are annealed, and thereafter worked into a desired size by drawing with a die or cold rolling. From the worked shape memory alloys raw material specimens H which are left as work-hardned and canonical specimens N which are annealed sufficiently at about 900° C. in accordance with JIS (Japanese Industrial Standard) are prepared. The specimens H and N are subject to a consecutive and slow heat cycle, and changes of their specific heat, electrical resistance, size, hardness, structure and the like are observed, respectively, and the transformation points and singular points of the raw shape memory alloys are measured. FIG. 1 schematically shows the general relationships between the transformation points and the singular points of the raw shape memory alloys. The numeric values in the figure represent only a rough standard. The temperatures of the transformation points and singular points vary considerably according to kinds of raw shape memory alloys. FIGS. 2 and 3 shows examples of actual measurement data of DSC.

With regard to the temperature range of heat cycle used for the measurement, the maximum heating temperature is selected to be about 800° C. and the minimum cooling temperature is selected to be −196° C. which is the temperature of liquid nitrogen. From the specimen H as work-hardened, mainly the temperature singular point S and the recrystallization temperature R are observed. Here, the temperature singular point S is an inflection point of physical properties representing transformations such as the specific heat, electrical resistance, hardness and the like which is observed between the temperature range D where a high level of plastic deformations are relaxed and the recrystallization temperature R (the temperature range D will be discussed later in more detail). At present, the inventor considers that this temperature singular point S is associated with the transformation of crystal grain boundaries. From the specimen N with which the recrystallization is performed by heating, the temperature singular point B is observed as well as the transformation points $A_s$, $A_f$, $M_s$ and $M_f$ which are associated with the shape memory effect. The temperature range D where only a high level of plastic deformation is relaxed is observed as the difference in the specific heat between the specimens N and H. The temperature singular point B is an inflection point of physical properties representing transformations such as the specific heat, electrical resistance and the like which is observed in the sub-zero temperature range and considered as a transformation point in the sub-zero temperature range. Though also in the specimen H, sometimes such singular point is observed, it is not distinct as in the case with the specimen N and its temperature is liable to differs a little from that observed in the specimen H, perhaps due to the internal stress. Therefore, as the transformation points, those observed in the specimen N are employed, except the temperature singular point S, the temperature range D and the recrystallization temperature R.

Though the temperature singular point B varies with the composition of alloys, in most cases it exists in a very low temperature range of −40° C. to −150° C. which is difficult to obtain without liquid nitrogen or the like. Accordingly, it is difficult to find the temperature singular point B under an ordinary metallurgical measurement environment. In some conditions of materials the temperature singular point B cannot be confirmed clearly. Accordingly, there is very little literature which refers to it. However, this temperature singular point B is an particularly important temperature in this embodiment. It seems that the $M_f$ point measured with the DSC, etc. is principally that of the interior of the grains which occupy the great portion of the crystals of the raw alloy. However, since the crystal grain boundaries are restrained between crystals having different orientations, it is considered that even on the $M_f$ temperature or below there still exists a component which remains as in a state near austenite phase, namely the retained austenite phase. Besides, since the elastic energy level at the crystal grain boundaries can be high because of work hardening due to plastic deformations and depositions of impurities which are peculiar to the crystal grain boundaries, it is no wonder that the $M_f$ point of the structure at and around grain boundaries alone lies at a lower temperature. The present inventor thinks that the temperature singular point B which is much lower than the $M_f$ point measured with the DSC is a $M_f$-point-like transformation point of the structure at and around the crystal grain boundaries. According to the data measured with the DSC, in most cases the respective transformation points and temperature singular points appear as gently-sloping inflection points and it is rarely the case that they have a distinct peak. The reason for this is thought that the raw alloys measured are polycrystalline substances each having crystals which are divergent in their sizes, orientations and conditions under which they are constrained. As a matter of fact, the temperatures which are commonly called transformation points are also represented by the central or average values of transformation temperature ranges having a certain width, respectively.

(Step 1)

Figure 4:
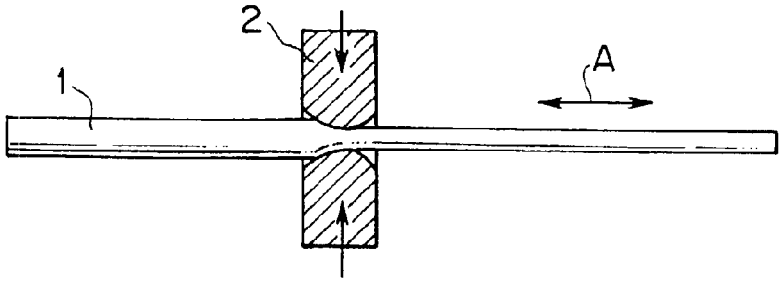
FIG. 4 is a cross-sectional view showing step 1 of the first embodiment.

A raw shape memory alloy material 1 manufactured by casting and hot working is annealed, and thereafter is subject to a high level of deformation so as to be formed into a wire shape by cold working, in such a manner that a great deformation extends sufficiently to the interior thereof and an anisotropy in the tensile direction remains therein. To be concrete, as shown in FIG. 4, the raw shape memory alloy 1 is subject to wire drawing with a die 2, repeatedly to the limit of work hardening at ordinary temperature or a cryogenic temperature with liquid nitrogen. By use of the die 2, external force are applied to the raw shape memory alloy 1 from every direction, and thereby most of the alloy crystals which have been produced upon the solidification of the ingot of the alloy or subsequent hot working and which are random in sizes and orientations are broken. However, even the raw shape memory alloy 1 is worked as such, since there is a degree of freedom in the tensile direction, a martensite-like component which causes contraction remains in the structure of the alloy. This component has an anisotropy in the tensile direction and becomes an important element which provides the crystals with a growth direction upon recrystallization in the step 2 which is explained hereunder. It is considered that such state of the raw shape memory alloy 1 after the cold working is amorphous-like one where the crystals are crushed almost completely, with the anisotropy being left in the longitudinal direction.

Though the cold working may be performed at ordinary temperature as stated before, it is preferable that it is performed at a cryogenic temperature, such as that of liquid nitrogen, which is sufficiently lower than the temperature singular point B. The purpose is to transform non-martensite structures remaining in the alloy, even if the amount of them are very small, to the martensite completely. In general, the so called martensite finished point $M_f$ is the temperature which is measured with respect to a specimen completely annealed, and in actual worked shape memory materials there remain a considerable amount of non-martensite structures even at that temperature. The non-martensite structures may be retained austenite, structure resulted from work hardening or the like. In this step 1 it is essential that the raw shape memory alloy 1 is worked so that the non-martensite structures remain as little as possible. If the austenite or the like component remains, in certain conditions of the worked alloy, sometimes it makes it possible for reversible slips to occur in the alloy, even if they are partial, and disturbs recrystallization with an anisotropy, and consequently making the following processes incomplete. This may eventually exerts a bad influence on the service life of the shape memory alloy with regard to the shape recovery rate and elongation thereof. Care should be also taken to a temperature rise due to work heat of the die 2. Particularly in case of Ti—Ni and Ti—Ni—Cu based shape memory alloys, the deformation resistance has a tendency to largely depend on the strain rate and thereby heat generation is easy to occur. With great stresses and a temperature rise, since the martensite and the austenite are present in a mixture, the martensite which is weaker in strength than the austenite is broken with priority and the austenite is liable to remain. It is difficult for the austenite which has completely transformed to have a directionality, and thereby an anisotropy in the tensile direction cannot be obtained. Therefore, care should be taken to the high speed work. Severe cold working at a temperature which is sufficiently lower than the temperature singular point B, such as that of liquid nitrogen, can realize the state which is almost ideal in this step. Under such a temperature, since almost the entire of the austenite in the raw shape memory alloy 1 is transformed to the martensite, the entire of the structure of the raw alloy 1 is broken uniformly except the martensite having the orientation suitable for the tensile direction. Stresses exerted by the remaining martensite become a factor presiding over the anisotropy of the recrystallization in the step 2 which will be explained hereunder.

By the way, besides wire drawing, cold rolling and shot blasting are effectual as the severe working. If the raw shape memory alloy is manufactured by sputtering or plating, it is thought that the structure thereof is already in an amorphous-like state, and thereby it is not necessary to break the crystal structure thereof by the severe cold working as in the step 1.

(Step 2)

Figure 5:
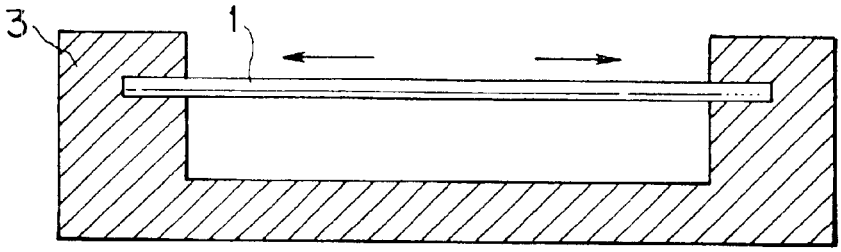
FIG. 5 is a cross-sectional view showing step 2 of the first embodiment.

The raw shape memory alloy 1 which has undergone the step 1 is fixed to a restraining device 3 at the both ends thereof, as shown in FIG. 5, with appropriate tension applied thereto. Consequently, the raw shape memory alloy 1 is subject to a stress in the tensile direction with the strain thereof restrained. Under such condition the raw shape memory alloy 1 is heated for a few seconds to several minutes to the temperature at which the recrystallization begins or a little above. By this, a substantially uniformly fine-grained equiaxed crystal structure with an anisotropy in the tensile direction is produced. The reason is that, it is thought, a large internal tensile stress is caused by heating due to the anisotropy in the tensile direction, and the recrystallization advances preferentially in such a direction that the internal stress is gradually relieved. When the raw alloy 1 is processed into such a state, the final size stability and movement property of the shape memory alloy is improved. There is not a severe restriction as to the magnitude of the stress applied to the raw shape memory alloy 1 prior to heating and restraining, because similar effects can be expected in a wide range thereof A deformed component which can be restored upon heating remains to some extent in the raw shape memory alloy 1 which has been subject to the severe cold working as in the step 1. Therefore, in this step, even if the alloy 1 is not subject to a stress and just restrained in its length so as not to become loose in the absence of a load, it attempts to contract upon heating, thereby a stress being produced therein, and consequently almost the same result can be attained as when the alloy is subject to a stress and the strain produced therein is restrained as stated above. Accordingly, such a condition can be employed as well. On the other hand, when the raw shape memory alloy 1 is restrained with a high level of stress applied thereto, the excessive stress is relaxed during the recrystallization and thereby it has little effect, but the finished shape memory alloy is deteriorated in the size accuracy. For instance, when the alloy in the shape of a wire is subject to an excessive tensile stress, it becomes thin. Basically, it is enough if the raw shape memory alloy 1 is loaded with an adequate stress in the tensile direction when the recovery recrystallization begins. What is essential is that the raw alloy 1 is subject to as little stress or constrain as possible except those in the tensile direction during the recrystallization. Actually in this embodiment, the raw alloy 1 is constrained with a stress of 10 to 100 Mpa applied thereto.

By the way, when mass production of the shape memory alloy in accordance with the present invention is considered, using a tunnel kiln, a similar process can be achieved, performing a similar heating treatment, while the raw shape memory alloy is subject to a stress by keeping an external force acting thereon instead of restraining it as stated above. However, in that case, perhaps because the obtained crystal structure which is fine-grained with the crystal orientations arranged is partly destroyed, a finished shape memory alloy is not so excellent in it properties as in the case where the raw alloy is restrained, and the control of the stress is difficult.

It is thought that the effect of the restraint with the stress applied to the raw alloy is as follows. In the material which has undergone the step 1 the formation of crystals due to the recrystallization is caused with priority in a part where a greater deformation is imparted such that the lattice structure is more disturbed and the stress field becomes stronger. When the crystal formation is achieved with the stress due to the external force in the tensile direction applied to the alloy, both the interior of the crystal grains and the grain boundaries come to a state where residual stresses and strains are eliminated in equilibrium with the stress. When from the raw alloy 1 thus processed the stress is removed by removal of the external force or constraint after cooling, the equilibrium of the internal stress which has been relaxed is disturbed and the raw alloy 1 becomes a material which structurally has a residual stress field being directional in the tensile direction therein. Besides, it is thought that generally when a crystal is formed, the impurity concentration is far richer outside the crystal being formed than the inside thereof and at last the impurities concentrate at the grain boundary (constitutional supercooling phenomenon). The impurities may be substances such as carbon, carbide, oxide and the like which differ in composition from the most part of the raw alloy 1. By means of the step 2, the impurities settle at positions where they are stable under the stress, and after cooling, with the stress removed, they are located partially in the tensile direction. It is thought that such anisotropy of the recrystallization and partiality in the tensile direction due to the impurities constitute an elastic energy barrier which prevents a plastic deformation from occurring and a cause of a stress field which induce the two-way shape memory effect. Moreover, the anisotropy facilitates the next step 3 and subsequent steps. As a matter of fact easiness of the two-way shape memory effect appearance depends on the carbon concentration.

In the step 2, the stronger covalent bonding property of the alloy is, the easier it is to produce fine crystal grains therein, perhaps because the less the thermal conductivity of the alloy is. At present it is easier to produce fine crystal grains in Ti—Ni—Cu based alloys than in Ti—Ni based ones. Though it is strictly a matter of comparison, when the heating temperature is too high or the heating time is too long, the finished shape memory alloy is inferior in properties as an actuator and unstable as a material, perhaps because the structure at around grain boundaries are lost or the crystal grains become too large. In general, there is a tendency that the larger the crystal grain sizes of shape memory alloys are, the larger the shape recovery strain and the shape recovery force are. However, in this treatment method, a good result is obtained when the raw alloy crystal structure is made as uniformly fine-grained and equiaxial as possible, having the grain size of a several microns or less, which grain size is small for ordinary metal materials. The reason for this is that the subsequent process of arranging crystal orientation is thought to be more important and the crystal grains are easy to rotate when their sizes are small and substantially uniform. Besides, it is thought that there is a grain size which is suitable for the repetition movement of the shape memory alloy and stable and it seems to be comparatively small. The optimum grain size for the treatment in accordance with the present invention also depends on material, shape and size of the raw alloy.

(Step 3)

Figure 6:
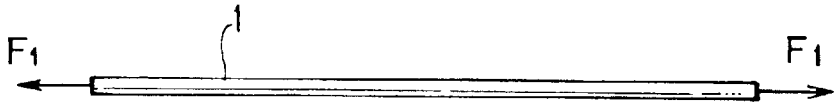
FIG. 6 is a cross-sectional view showing step 3 of the first embodiment.
Figure 7:
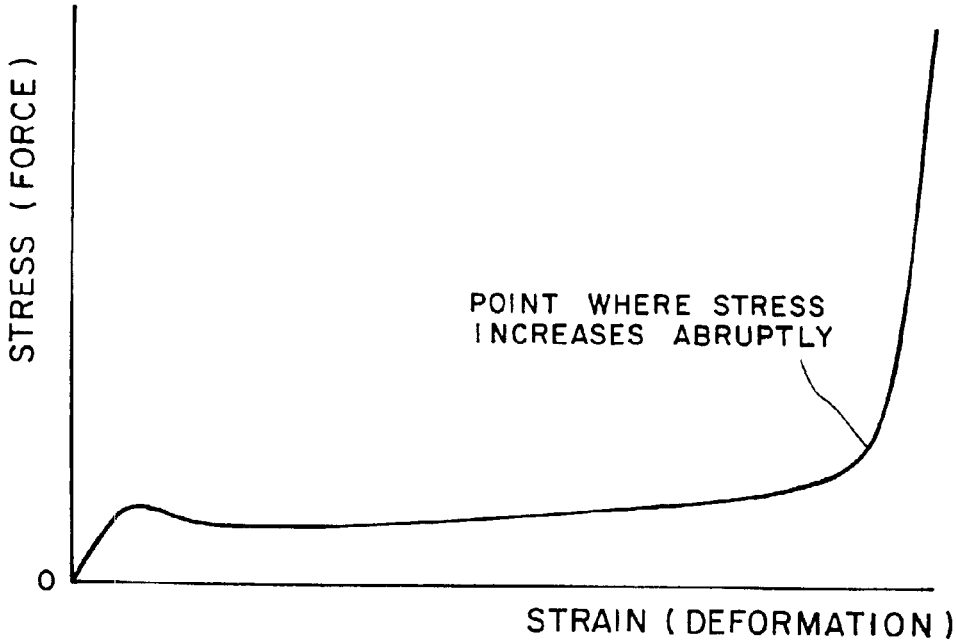
FIG. 7 is an example of stress-strain diagram in the step 3 of the first embodiment.

After the completion of the step 2, as shown in FIG. 6, the raw alloy 1 is newly subject to a large tensile force $F_1$ under a free tensile condition without constraint with regard to the cross-sectional direction at a cryogenic temperature which is sufficiently lower than the temperature singular point B and at which it is completely in martensite state, until the reaction force increases rapidly, and a deformation is imparted thereto in the tensile direction. Since sometimes the temperature singular point B is changed by a great stress and deformation, the above described cryogenic temperature is obtained using dry ice or liquid nitrogen. As such, it is thought that both the interior of the crystal grains and the grain boundaries are completely in the martensite state. The principal point is that the raw alloy 1 is deformed in a state where neither within the crystal grains nor the grain boundaries the austenite phase remain. Especially the interior of the crystal grain, being very soft, is readily deformed by the external force and does not resist it in the range where the reversible slip of the atoms occur as described before. This huge deformation strain within the crystal grain reaches to tens to hundreds times the elastic strain seen with common metals. On the other hand, the structure at and around the grain boundaries which is situated between crystal grains having different orientations and is restrained by them cannot move freely, unlike the structure within the crystal grains, and consequently, with deformations of the neighboring crystal grains, is deformed particularly in a direction wherein the crystal grains slide against each other in accordance with the external force. This huge slip deformation is, for the structure at and around grain boundaries, a plastic deformation which exceeds the reversible slip range. In the alloy 1 as a whole the external force is relieved and a deformation is produced in such a way that the strain are stored at the structure at and around the grain boundaries. During this process it is necessary not to apply the force to the raw alloy 1 so excessively that the plastic deformation reaches to the interior of crystal grains. The limit of the force is easily learned by observing consecutively a stress-strain diagram as shown in FIG. 7. In the case that the raw shape memory alloy 1 is in the shape of a wire as in this embodiment, when it undergoes a free tensile deformation without external forces other than that in the tensile direction applied thereto at a cryogenic temperature, the deformation occurs with a comparatively small force to a certain point, but then abruptly the reaction force increases, and so the stress. The limit of the force is learned from the point at which the stress increases abruptly. In the event that an excessive deformation is imparted to the raw alloy 1 in disregard of the magnitude of the reaction force, the plastic deformation reaches to the interior of the crystal grains, causing a fear of internal defects occurring in the alloy and its abrupt rupture. In general, it is preferable to apply a stress of 300 to 500 Mpa to the raw alloy 1.

In order to obtain more excellent properties in the tensile direction, preferably a free tensile deformation wherein there is no restraint except in the specific direction, or the like, is subject to the raw alloy 1, as in this embodiment. When an alloy having comparatively small cross section is deformed in such state, rotations and slips between the crystal grains occur easily, because constraint is small in the cross section. On the contrary a high level of deformation, such as that by wire drawing, which restrains even movement of the crystals in the raw alloy decreases the effect of this step.

(Step 4)

Figure 8:
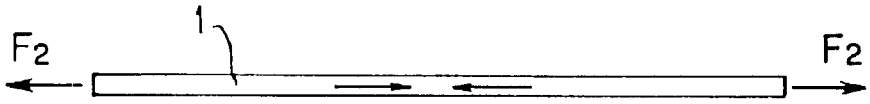
FIG. 8 is a cross-sectional view showing step 4 of the first embodiment.

After the completion of the step 3, the raw shape memory alloy 1 is heated to the vicinity of the temperature singular point S at a heating rate which does not cause the deposition and diffusion (for instance, 100 to 200° C./min) with a tensile fore $F_2$ which is smaller than that in the step 3 being applied thereto, as shown in FIG. 8, in a free tension manner without restraint in the cross-sectional direction thereof, and thereafter cooled. The force $F_2$ is selected to be such a small one that it will not cause a deformation continuously in the tensile direction. In this step, also, it may be better to say that the strain is not imparted forcibly but the stress is controlled. In general, preferably the stress is 100 to 200 Mpa. Similar result is obtained when the raw alloy 1 is heated to the temperature singular point S under constraint with being pre-deformed in the tensile direction, since a shape recovery force is produced. But in this case the strain under constraint is difficult to control. In this step the interior of the crystal grains become the austenite phase which is hard, and thereby the structure at and around grain boundaries is brought into a state where it is restrained. At the temperature S, the structure within the crital grains, having no excessive deformation and being comparatively well-ordered in its atomic arrangement, is stable and seldom makes a change. On the other hand, the structure at and around the grain boundaries, where a high level of crystalline distortions due to the large plastic deformation have been induced in the step 3, is thought to be higher than that within the crystal grains in the elastic energy level or the level of mechanical energy which tries to restore the crystals to their original state. Therefore, the structure at and around the grain boundaries is liable to undergoes a change like the recrystallization and revert to a more stable status by less heat energy. Thus in this step 4 the structure at and around the crystal grains alone selectively undergoes irreversible slip deformations and consequently the adjoining crystal grains slide along each other so that the tensile force from the outside is relaxed. Taking a broader view of it, it means that, when the respective crystal grains take place a reversible deformation due to the shape memory effect, they rotate so that they are arranged in their orientations and can move more smoothly. In other words, all of the crystal grains are arranged in a direction in which the movement of the shape memory alloy in the expected operational direction, namely the tensile direction, is obstructed less. Since crystal grains of shape memory alloys have many crystal planes in three dimensions, where reversible deformations referred to as variants readily occur (for instance, in case of a Ti—Ni based shape memory alloy, there are as much as twenty four (24) orientations along which the deformations referred to as variants can occur), with a comparatively slight rotation each of the crystal grains can settle in the direction suitable for the deformation in the tensile direction. Once settled in the stable direction, each of the crystal grains can take place a reversible deformation to the maximum when the alloy as a whole is subject to a tensile deformation. Accordingly, a force rotating them further is hardly produced. In other words the alloy becomes stable as a material. In the event that the step 2 is not carried out well and consequently the crystal grains are uneven in their size, excessive stresses and deformations are produced in the interior of crystal grains which lacks conformity and the alloy becomes materially unstable. In case the load, temperature and heating time are not adequate, the crystal grains do not rotate, and moreover, the change reaches even the interior of the crystal grains, and consequently the properties of the alloy become deteriorated.

The phenomenon which occurs in the steps 3 and 4 which is associated with the fine-grained polycrystalline material seems to be that similar to the ultra fine grain super plasticity. A great difference between the phenomenon related to the present invention and the ultra fine grain super plasticity which heretofore has been known is that in the present invention the process is finished before the stage where a continuous deformation lasts is reached. However, when the alloy is held for a longer time at a heating temperature higher than the singular point S and deformed slowly, sometimes a large permanent strain is produced.

(Step 5)

If necessary, the step 3 is carried out again with the raw shape memory alloy 1 which has undergone the step 4. Generally, there is a tendency that, when the process of the steps 3 and 4 is carried out once, most of the crystal grains are successfully arranged in a direction suitable for the expected operational direction, and even if the process is repeated, the effect is decreased logarithmically with the number of repetitions. However, the result of the steps 3 and 4 differs with alloys and in some cases the number of repetitions delicately affects properties of the finished shape memory alloy. Therefore, in some cases, as the steps 3 and 4 are repeated alternately, the properties of finished shape memory alloy are improved gradually. The reason for this is thought to be that in certain cases the intermetallic compound which forms the alloy has a smaller number of orientations in which variants are easily produced, depending on impurities included therein and the composition and histories thereof. In practice it is preferable to determine the number of repetitions from results of a operation test for the shape memory alloy with which all the processes of the treatment have been completed once. One standard judgement to determine the appropriate number of repetitions is to confirm that the stress when the alloy undergoes a deformation at the cryogenic temperature becomes sufficiently smaller than that in the first step 3 or zero.

(Step 6)

The raw shape memory alloy 1 is repeatedly heated and cooled between a maximum heating temperature and a minimum cooling temperature with a force applied thereto. The maximum heating temperature is selected to be in the vicinity of the temperature D, and the minimum cooling temperature is selected to be the $M_f$ point or below, preferably a cryogenic temperature similar to that in the step 3. The force is selected to be larger than that which is expected to be applied to the shape memory alloy when it is used as an actuator but not so large as to damage it. Though it depends on circumstances, in general a stress of 100 to 300 Mpa is thought to be preferable. In this step the movement of the alloy 1 by the heating and cooling cycle should not be restrained. It is more effective to set the magnitude of the force to be larger upon cooling than upon heating. This step work hardens the structure at and around the grain boundaries adequately to secure the dimensional stability of the alloy and induces an elastic energy field in the alloy in a direction opposite to that of the shape recovery of the alloy due to the shape memory effect, as is the case with conventional training processes of shape memory alloys. The completion of this step finishes all the processes of the treatment.

Figure 9:
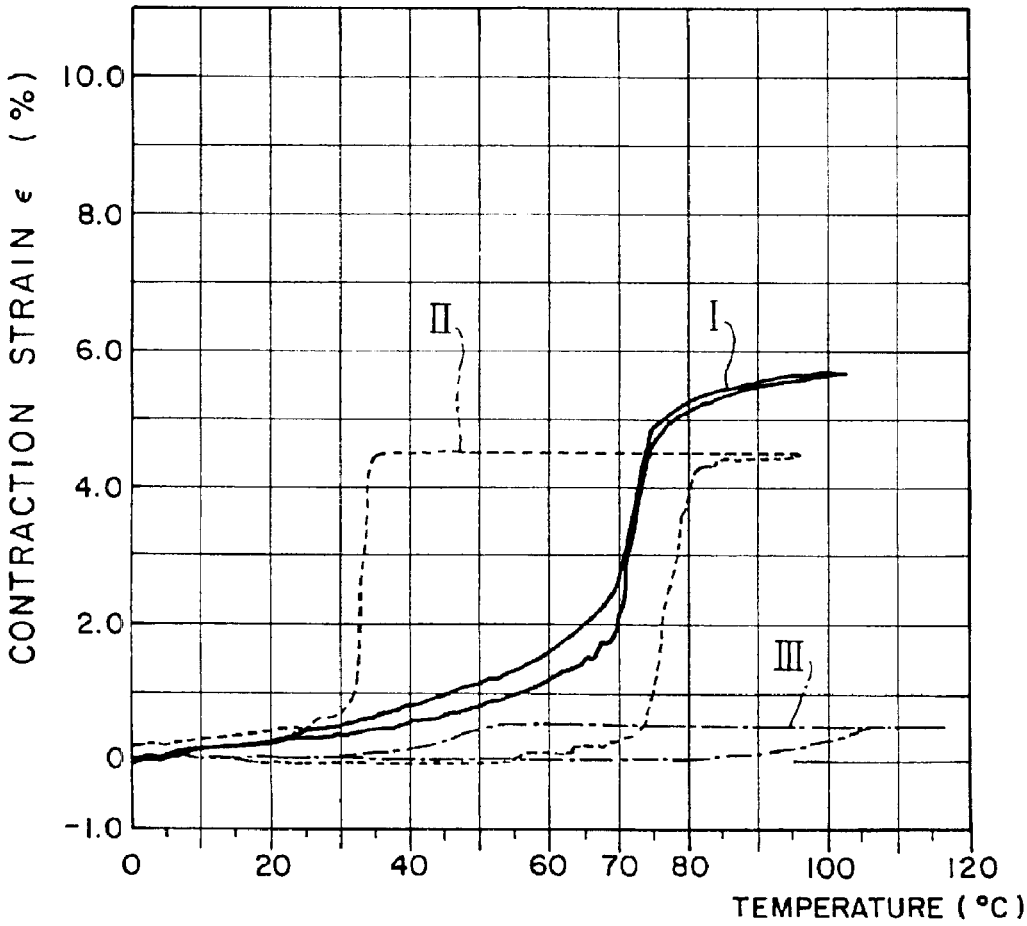
FIG. 9 is a presentation of the comparison of the stress-strain curve of the shape memory alloy obtained by the first embodiment with those of conventional shape memory alloys.
Figure 10:
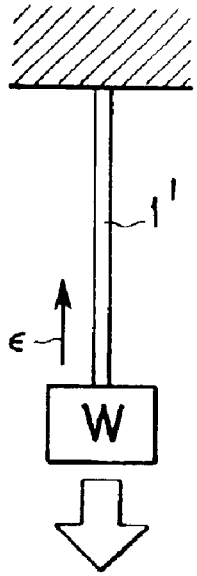
FIG. 10 is a explanatory drawing showing the test condition for measuring the characteristics of FIG. 9.

The curve I in FIG. 9 shows an example of a temperature-strain characteristic of a Ti—Ni—Cu based shape memory alloy obtained by this embodiment. In FIG. 9 characteristics of conventional shape memory alloys for actuators (curves II and III) are also shown for comparison. FIG. 10 shows test conditions for measuring the characteristic of FIG. 9, wherein relations between the temperature and shrinkage displacement (contraction strain $\epsilon$) of the respective shape memory alloys 1' in the shape of a wire are measured in a thermostat (constant temperature oven) controlled at the temperature change 10° C./min with a load of 100 Mpa to the shape memory alloys 1'. As shown by the curve I in FIG. 9, as for the shape memory alloy obtained by this embodiment the temperature hysteresis is almost zero in a comparatively wide range. Both the conventional shape memory alloy shown by the curve II, which is of a high temperature type that operates at a comparatively high temperature, and the conventional shape memory alloy shown by the curve III, which has been processed with the medium treatment, exhibit large hysteretic characteristics.

FIGS. 11 through 16 show a second embodiment of the method of treating a shape memory alloy in accordance with the present invention. In this embodiment it is expected that the finished shape memory alloy takes the shape of a coil or helical spring, and when used as an actuator, it contracts to the memorized (original) coil length upon heating, while it relaxes and elongates to the original deformed coil length at a low temperature upon cooling (namely it operates as an extension spring), or it elongates to the memorized coil length upon heating, while it relaxes and contracts to the original deformed coil length at a low temperature upon cooling (namely it operates as a compression spring). In this embodiment the expected operational direction is a twisting direction.

(Preparatory operation)

An operation similar to the preparatory operation in the first embodiment is carried out.

(Step 1)

An operation similar to the step 1 in the first embodiment is carried out to prepare a raw shape memory alloy 1 in the shape of a wire having predetermined diameter. Though an anisotropy in the tensile direction remains in the raw shape memory alloy 1, it has substantially no effect on the characteristics of the finished shape memory alloy to be obtained at the end.

(Step 2)

Figure 11:
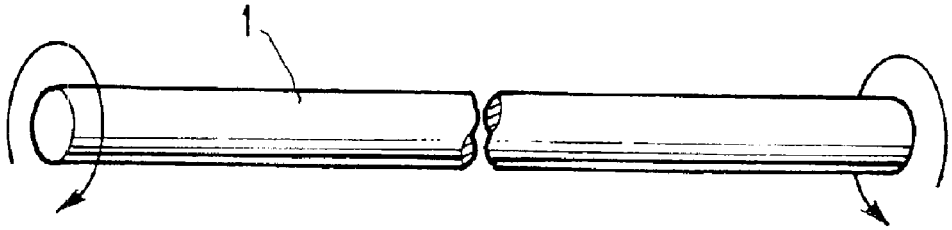
FIG. 11 is a perspective view showing a state where a raw shape memory alloy is subject to a twisting deformation in step 2 of a second embodiment of the treatment in accordance with the present invention.
Figure 12:
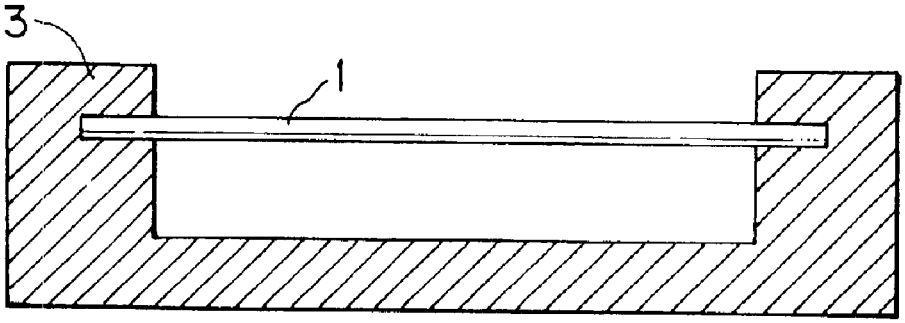
FIG. 12 is a cross-sectional view showing a state where the raw shape memory alloy torsionally deformed in the step 2 of the second embodiment is heated under restraint.

The raw shape memory alloy 1 which has undergone the step 1 is twisted sufficiently in the expected operational direction as shown in FIG. 11 to receive a twisting deformation, and then, restrained, as it is, by a constraining device 3 as shown in FIG. 12. Though the twisting deformation may be achieved at ordinary temperature, it is preferable that it is performed at a cryogenic temperature which is sufficiently lower than the temperature singular point B for the same reason as in the first embodiment. Thereafter the raw shape memory alloy 1 is heated for a short period of time to the temperature at which the recrystallization begins or a little above while constrained as stated above. Then a great internal shearing stress is produced in the alloy 1 due to its anisotropy in the twisting direction, and the recrystallization occurs preferentially in such a direction that the internal shearing stress is relieved, and consequently a substantially uniformly fine-grained crystal structure having an anisotropy in the twisting direction is produced.

(Step 3)

Figure 13:
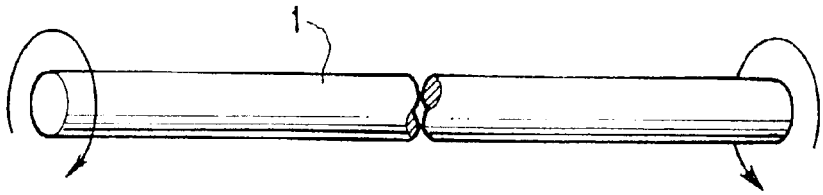
FIG. 13 is a perspective view showing step 3 of the second embodiment.

The raw shape memory alloy 1 which has undergone the step 2 is subject to an additional twisting deformation in the same direction with a large twisting force as shown in FIG. 13 at a low or cryogenic temperature at which it is completely in martensite state until the reaction force increases rapidly. Hereupon the twisting torque imparted to the raw alloy 1 should be controlled so as to prevent the plastic deformation from reaching to the interior of crystal grains as in the first embodiment. The deformation should be restrained as little as possible except in the twisting direction.

(Step 4)

Figure 14:
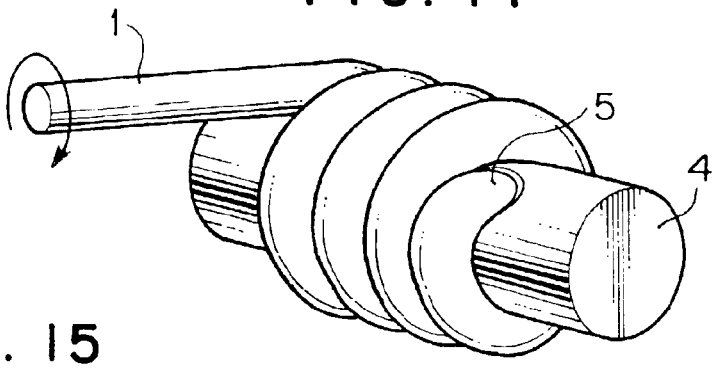
FIG. 14 is a perspective view showing step 4 of the second embodiment.

As shown in 14, the raw shape memory alloy 1 which has undergone the step 3 is wound around a core bar 4 having a round cross-sectional shape so that the twisting deformation may not be dissolved. The raw alloy 1 may be wound while being twisted. In the drawings, a part where one end of the raw alloy 1 is fixed to the round core bar 4 is denoted at 5". Whether the finished shape memory alloy 1 is to form an extension spring or compression springs depends on the winding direction. FIG. 14 shows the case where the finished shape memory alloy is to form an extension spring. In the case that the finished shape memory alloy is to form an compression spring, the raw alloy 1 is wound around the core bar 4 in the opposite direction. When the finished shape memory alloy is supposed to form an extension spring, if the raw alloy 1 is wound around the core bar 4 while strongly twisted, it forms a coil shape for itself rather than being forcibly wound around the core bar 4.

(Step 5)

Figure 15:
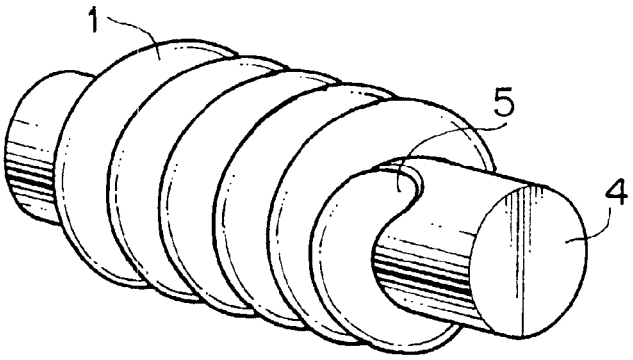
FIG. 15 is a perspective view showing step 5 of the second embodiment.

Next, while being restrained in the state where it is wound around the core bar 4 and twisted as shown in FIG. 15, the raw alloy 1 is heated to the temperature singular point S at a heating rate which does not cause the deposition and diffusion (for instance, 100 to 200° C./min) and thereafter cooled. Consequently, the crystals of the raw alloy 1 is reoriented along a direction suitable for the expected operational direction, namely the twisting direction, as is the case with the first embodiment. Since in the step 4 the raw alloy 1 is subject to a bending deformation as well as the twisting deformation, a higher level of deformation may be imparted to it, as compared with the first embodiment, inducing work hardening in some parts of it. Therefore, there are cases where it is preferable to determine the heating temperature to be little higher and the heating time to be short in order to remove excessive work hardening.

(Step 6)

Figure 16:
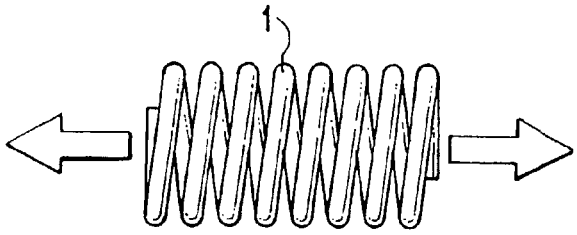
FIG. 16 is a perspective view showing step 6 of the second embodiment.

The core bar 4 is pulled out from the raw alloy 1, and at a cryogenic temperature the coil of the raw alloy 1 is deformed so as to be elongated as shown in FIG. 16 when it is of a extension type, while it is deformed so as to be compressed when it is of a compression type. Instead of it, mere cooling the raw alloy 1 to a cryogenic temperature while it is still wound around the core bar 4 is also effective to the some extent, perhaps because a stress remains in the raw alloy 1. There are cases where it improves further the performances of the finished shape memory alloy to stretch properly the coil of the raw shape memory alloy 1 which has been obtained as stated above and thereafter to repeat the steps 3 to 6 several times.

(Step 7)

When necessary, the raw shape memory alloy 1 obtained by the step 6 is subject to a heat cycles of more than a few cycles between a low or cryogenic temperature and the temperature D while the raw shape memory alloy 1 is subject to a force in the expected operational direction without constraining the deformation thereof. This step is a running-in or training process which corresponds to the step 6 in the first embodiment. Upon completion of this step, all processes of the treatment is completed.

The present invention can be applied to shape memory alloys which are different in their shapes and movements from those in the above embodiments. Even if manners of deformation are different, basic processes of the treatment are same.

Although preferred embodiments of the present invention have been shown and described herein, it should be apparent that the present disclosure is made by way of example only and that variations thereto are possible within the scope of the disclosure without departing from the subject matter coming within the scope of the following claims and a reasonable equivalency thereof.

What is claimed is:

1. A shape memory alloy being polycrystallane and having a substantially uniformly fine-grained crystal structure, crystal orientations thereof being arranged substantially along a direction suitable for an expected operational direction wherein said shape memory alloy is selected from the group consisting of a wire having a solid round cross section, a plate, and a coil, and wherein said shape memory alloy is prepared by a process comprising the steps of:

(a) providing a raw shape memory alloy having a substantially uniformly fine-grained crystal structure; and (b) arranging crystal orientations of said raw shape memory alloy substantially along a direction suitable for an expected operational direction wherein step (a) comprises the step of:

(c) heating said raw shape memory alloy in an amorphous state or a state similar thereto to the temperature at which recrystallization begins or a little above for a short period of time, with a stress applied to said raw shape memory alloy in said expected operational direction at least in the stage where a recovery recrystallization begins, to produce a substantially uniform fine-grained crystal structure with an anisotropy in said expected operational direction, while relaxing the internal stress generated in said raw shape memory alloy in said expected operational direction; and step (b) comprises the steps of:

(d) subjecting said raw shape memory alloy to a high level of deformation by means of a stress in said expected operational direction at a very low temperature at which the austenite phase does not remain in said raw shape memory alloy so that a slide deformation is introduced into the crystal grains of said raw shape memory alloy which have been transformed completely into the martensite phase within a reversible range along the direction of said stress;

(e) heating said raw shape memory alloy to a temperature between $A_f$ and the recrystallization temperature with a stress applied to said raw shape memory alloy in said expected operational direction so that the directions of reversible slip motions of the respective crystal grains of said raw shape memory alloy are arranged in a direction suitable for said expected operational direction.

2. A shape memory alloy as set forth in claim 1, wherein the average grain diameter of crystals is 10 microns or less.

3. A shape memory alloy as set forth in claim 1, wherein prior to step (c), said raw shape memory alloy is subject to a severe cold working so that the crystal structure thereof is destructed and is brought to a state similar to an amorphous state.

4. A shape memory alloy as set forth in claim 1, wherein said shape memory alloy is an intermetallic compound.

5. A shape memory alloy as set forth in claim 4, wherein said shape memory alloy is a Ti—Ni based alloy.

6. A shape memory alloy as set forth in claim 4, wherein said shape memory alloy is a Ti—Ni—Cu based alloy.

7. A shape memory alloy as set forth in claim 1, wherein said expected operational direction is a tensile direction.

8. A shape memory alloy as set forth in claim 1, wherein said expected operational direction is a torsion direction.

9. A shape memory alloy as set forth in claim 1, wherein said shape memory alloy is in a form of a wire.

10. A shape memory alloy being polycrystalline and having a substantially uniformly fine-grained crystal structure, crystal orientations thereof being arranged substantially along a direction suitable for an expected operational direction wherein said shape memory alloy is selected from the group consisting of a wire having a solid round cross section, a plate, and a coil, and wherein said shape memory alloy is prepared by a process comprising the steps of:

(g) subjecting a raw shape memory alloy having an anisotropy in an expected operational direction to a high level of deformation by means of a stress in said expected operational direction at a very low temperature at which the austenite phase does not remain in said raw shape memory alloy so that a slide deformation is introduced into the crystal grains of said raw shape memory alloy which have been transformed completely into the martensite phase within a reversible range along the direction of said stress;

(h) heating said raw shape memory alloy to a temperature between the austenite transformation terminate temperature $A_f$ and the recrystallization temperature with a stress applied to said raw shape memory alloy in said expected operational direction so that the directions of reversible slip motions of the respective crystal grains of said raw shape memory alloy are arranged in a direction suitable for said expected operational direction.

11. A shape memory alloy as set forth in claim 10, wherein the average grain diameter of crystals is 10 microns or less.

12. A shape memory alloy as set forth in claim 10, wherein said expected operational direction is a tensile direction.

13. A shape memory alloy as set forth in claim 10, wherein said expected operational direction is a torsion direction.

14. A shape memory alloy as set forth in claim 10, wherein said shape memory alloy is in a form of a wire.

15. A shape memory alloy as set forth in claim 10, wherein said shape memory alloy is an intermetallic compound.

16. A shape memory alloy as set forth in claim 15, wherein said shape memory alloy is a Ti—Ni based alloy.

17. A shape memory alloy as set forth in claim 15, wherein said shape memory alloy is a Ti—Ni—Cu based alloy.

18. A method of making a shape memory alloy that is polycrystalline and has a substantially uniformly fine-grained crystal structure, crystal orientations thereof being arranged substantially along a direction suitable for an expected operational direction wherein said shape memory alloy is selected from the group consisting of a wire having a solid round cross section, a plate, and a coil, and wherein said method comprises the steps of:

(a) providing a raw shape memory alloy having a substantially uniformly fine-grained crystal structure; and (b) arranging crystal orientations of said raw shape memory alloy substantially along a direction suitable for an expected operational direction wherein step (a) comprises the step of:

(c) heating said raw shape memory alloy in an amorphous state or a state similar thereto to the temperature at which recrystallization begins or a little above for a short period of time, with a stress applied to said raw shape memory alloy in said expected operational direction at least in the stage where a recovery recrystallization begins, to produce a substantially uniform fine-grained crystal structure with an anisotropy in said expected operational direction, while relaxing the internal stress generated in said raw shape memory alloy in said expected operational direction; and step (b) comprises the steps of:

(d) subjecting said raw shape memory alloy to a high level of deformation by means of a stress in said expected operational direction at a very low temperature at which the austenite phase does not remain in said raw shape memory alloy so that a slide deformation is introduced into the crystal grains of said raw shape memory alloy which have been transformed completely into the martensite phase within a reversible range along the direction of said stress;

(e) heating said raw shape memory alloy to a temperature between $A_f$ and the recrystallization temperature with a stress applied to said raw shape memory alloy in said expected operational direction so that the directions of reversible slip motions of the respective crystal grains of said raw shape memory alloy are arranged in a direction suitable for said expected operational direction.

19. The method as set forth in claim 18, wherein the average grain diameter of crystals is 10 microns or less.

20. The method as set forth in claim 18, wherein prior to step (c), said raw shape memory alloy is subject to a severe cold working so that the crystal structure thereof is destructed and is brought to a state similar to an amorphous state.

21. The method as set forth in claim 18, wherein said shape memory alloy is an intermetallic compound.

22. The method as set forth in claim 21, wherein said shape memory alloy is a Ti—Ni based alloy.

23. The method as set forth in claim 21, wherein said shape memory alloy is a Ti—Ni—Cu based alloy.

* * * * *